US009237820B2

(12) United States Patent
Forbes et al.

(10) Patent No.: US 9,237,820 B2
(45) Date of Patent: Jan. 19, 2016

(54) ORNAMENT ASSEMBLY WITH ATTACHMENT CLIP

(71) Applicant: TARGET BRANDS, INC., Minneapolis, MN (US)

(72) Inventors: Kathryn D. Forbes, Minnetonka, MN (US); Monica R. Rush, Minneapolis, MN (US)

(73) Assignee: TARGET BRANDS, INC., Minneapolis, MN (US)

( * ) Notice: Subject to any disclaimer, the term of this patent is extended or adjusted under 35 U.S.C. 154(b) by 13 days.

(21) Appl. No.: 14/323,625

(22) Filed: Jul. 3, 2014

(65) Prior Publication Data

US 2015/0017382 A1 Jan. 15, 2015

Related U.S. Application Data

(60) Provisional application No. 61/843,601, filed on Jul. 8, 2013.

(51) Int. Cl.
*A47G 33/10* (2006.01)
*A47G 33/08* (2006.01)

(52) U.S. Cl.
CPC ..... *A47G 33/10* (2013.01); *A47G 33/08* (2013.01); *A47G 2033/089* (2013.01); *A47G 2033/0827* (2013.01); *Y10T 29/49895* (2015.01); *Y10T 428/24008* (2015.01)

(58) Field of Classification Search
CPC ..... Y10T 428/24008; A47G 33/10; F16L 3/1203; F16M 13/022
See application file for complete search history.

(56) References Cited

U.S. PATENT DOCUMENTS

| | | | | |
|---|---|---|---|---|
| 2,053,139 | A | 9/1936 | Donovan et al. | |
| 2,063,924 | A | 12/1936 | Hanko | |
| 2,521,394 | A | 9/1950 | Minners | |
| 2,599,303 | A | 6/1952 | Ward | |
| 3,386,070 | A | 5/1968 | Jansson et al. | |
| 5,549,268 | A * | 8/1996 | Hopwood | A47B 21/045 248/316.5 |

(Continued)

FOREIGN PATENT DOCUMENTS

DE 3239082 A1 4/1984

OTHER PUBLICATIONS

"Candle Clip-On Ornaments", printed from http://store.gianis.com/gm501r.html available at least as early as Sep. 14, 2011 (1 page).

(Continued)

*Primary Examiner* — Alexander Thomas
(74) *Attorney, Agent, or Firm* — Griffiths & Seaton PLLC; Joann M. Seaton

(57) ABSTRACT

An ornament assembly includes an attachment clip, an elongated shaft, and an ornament. The attachment clip includes a first jaw and a second jaw. The first jaw includes a first spine and a first finger extending from the first spine. The second jaw includes a second spine and a second finger extending from the second spine toward the first finger. The elongated shaft includes a first end and a second end. The second end of the elongated shaft is coupled to each of the first spine and the second spine such that at least one of the first jaw and the second jaw rotates about the elongated shaft to move the attachment clip between an open position and a closed position. The ornament is coupled to the first end of the elongated shaft such that the ornament is spaced from the attachment clip via a length of the elongated shaft.

18 Claims, 13 Drawing Sheets

(56) References Cited

U.S. PATENT DOCUMENTS

| | | | |
|---|---|---|---|
| 5,975,092 | A | 11/1999 | Tsai |
| 5,988,184 | A | 11/1999 | Shu |
| 7,175,145 | B2 | 2/2007 | Simpson |
| 7,419,277 | B2 | 9/2008 | Von Ronn et al. |
| 7,419,283 | B2 | 9/2008 | Von Ronn et al. |
| 7,493,903 | B2 | 2/2009 | Rogers et al. |
| 7,717,388 | B2 | 5/2010 | Rizzo |
| 7,992,579 | B2 | 8/2011 | Longoria et al. |
| 8,109,279 | B2 | 2/2012 | Chudzik et al. |
| 8,186,364 | B2 | 5/2012 | Silva |
| 8,276,598 | B1 | 10/2012 | Shepard et al. |
| 8,863,761 | B2 | 10/2014 | Wang |
| 2007/0029222 | A1 | 2/2007 | Shepardson |
| 2007/0031635 | A1 | 2/2007 | Shepardson |
| 2010/0096526 | A1 | 4/2010 | Richardson |
| 2011/0114807 | A1 | 5/2011 | Richardson |

OTHER PUBLICATIONS

Photograph of Hair Clip, admitted prior art (1 page).

"What is it with Boys Being Obsessed with Hair Clips?" printed from http://sheenaspace.wordpress.com/2012/05/01/what-is-it-with-boys-being-obsessed-with-hair-clips/ published May 1, 2012 (2 pages).

"Club Pack of 24 Red and Gold Glass Candle Clip-On Christmas Ornaments 5.5", printed from http://shop.christmascentral.com/items/item.aspx?itemid=10836187 available at least as early as Sep. 14, 2011 (2 pages).

"Classic Medium Claw Clips", printed from www.goody.com/Products/Hair_Accessories/Classics_Medium_Claw_Clips, admitted prior art (1 page).

"Holiday Hair", printed from www.styleblueprint.com/health-and-beauty/holiday-hair/ posted on Dec. 8, 2011 (7 pages).

Office Action from Canadian Patent Application No. 2,855,846, mailed Sep. 22, 2014 (4 pages).

GKI Bethlehem Lighting Reflections Novelty Christmas Tree Topper with Morphing LED and Mounting Arm, Bethlehem Star. GKI Bethlehem Lighting. Amazon.com, May 3, 2011 (oldest review date Jan. 7, 2009) [retrieved on Sep. 16, 2014]. Retrieved from the Internet: <http://www.amazon.com/GKI-Bethlehem-Lighting-Reflections-Christmas/dp/B0014XUTMG> (6 pages).

* cited by examiner

ORNAMENT ASSEMBLY WITH ATTACHMENT CLIP

CROSS-REFERENCE TO RELATED APPLICATION

This application is a non-provisional application of and claims priority to U.S. Provisional Patent Application No. 61/843,601, filed Jul. 8, 2013, which is incorporated herein by reference.

This application is related to U.S. Design patent application Ser. No. 29/460,102, filed Jul. 8, 2013, now D736075.

BACKGROUND OF THE INVENTION

Seasonal decorating has long been a tradition across many cultures. Decorating efforts are often at their peak during the holiday seasons, for example, when Christmas trees become the center of many homes. Ornaments and decorations of a plurality of types are placed to adorn the trees. A feature ornament, such as a star or angel, is typically placed on the highest branch as a tree top decoration. Placement of the feature ornament at the top of the tree is a rather challenging undertaking as it can often be difficult to balance an ornament in a desired upright manner in a desired position above the tree while simultaneously coupling the ornament to the tree. Similar issues apply to the selective coupling of ornaments and decorations throughout homes, businesses, or other suitable environments.

SUMMARY OF THE INVENTION

One example of an ornament assembly according to the present invention includes an attachment clip, an elongated shaft, and an ornament. The attachment clip includes a first jaw, which includes a first spine and a first finger curvilinearly extending from the first spine, and a second jaw, which includes a second spine and a second finger curvilinearly extending from the second spine toward the first finger. The elongated shaft includes a first end and a second end opposite the first end. The second end of the elongated shaft is coupled to each of the first spine and the second spine such that at least one of the first jaw and the second jaw rotates about the elongated shaft to move the attachment clip between an open position, in which the first finger and the second finger are spaced from one another, and a closed position, in which the first finger and the second finger are positioned adjacent one another. The ornament is coupled to the first end of the elongated shaft such that the ornament is spaced from the attachment clip via a length of the elongated road. Other assemblies, clips, methods, etc. are also disclosed.

BRIEF DESCRIPTION OF THE DRAWINGS

Embodiments of the invention will be described with respect to the figures, in which like reference numerals denote like elements, and in which.

DETAILED DESCRIPTION

The present invention relates to an attachment device for securely coupling an ornament to a branch of a tree or other support member. The attachment device is, in one embodiment, an attachment clamp or clip coupled to the ornament via an elongated shaft. The attachment clip is formed of two jaws, and each of the two jaws is rotatable relative to the other about the elongated shaft to selectively wrap around the support member. The attachment clip jaws are biased toward one another in a closed position, in which the attachment clip jaws selectively wrap around the support member. In one embodiment, each attachment clip jaw includes curved fingers that are at least partially interposed with the curved fingers of the other attachment clip jaw when the attachment clip is closed. In one example, a row of teeth or grips extends along a length of each curved finger of the attachment clip to facilitate the attachment clip in grasping the support member and decreasing slippage of the clip along the support member, especially when the ornament has a fairly substantial weight. In one example, the elongated shaft maintains the clip spaced from the corresponding ornament a desired distance.

Figure 1:
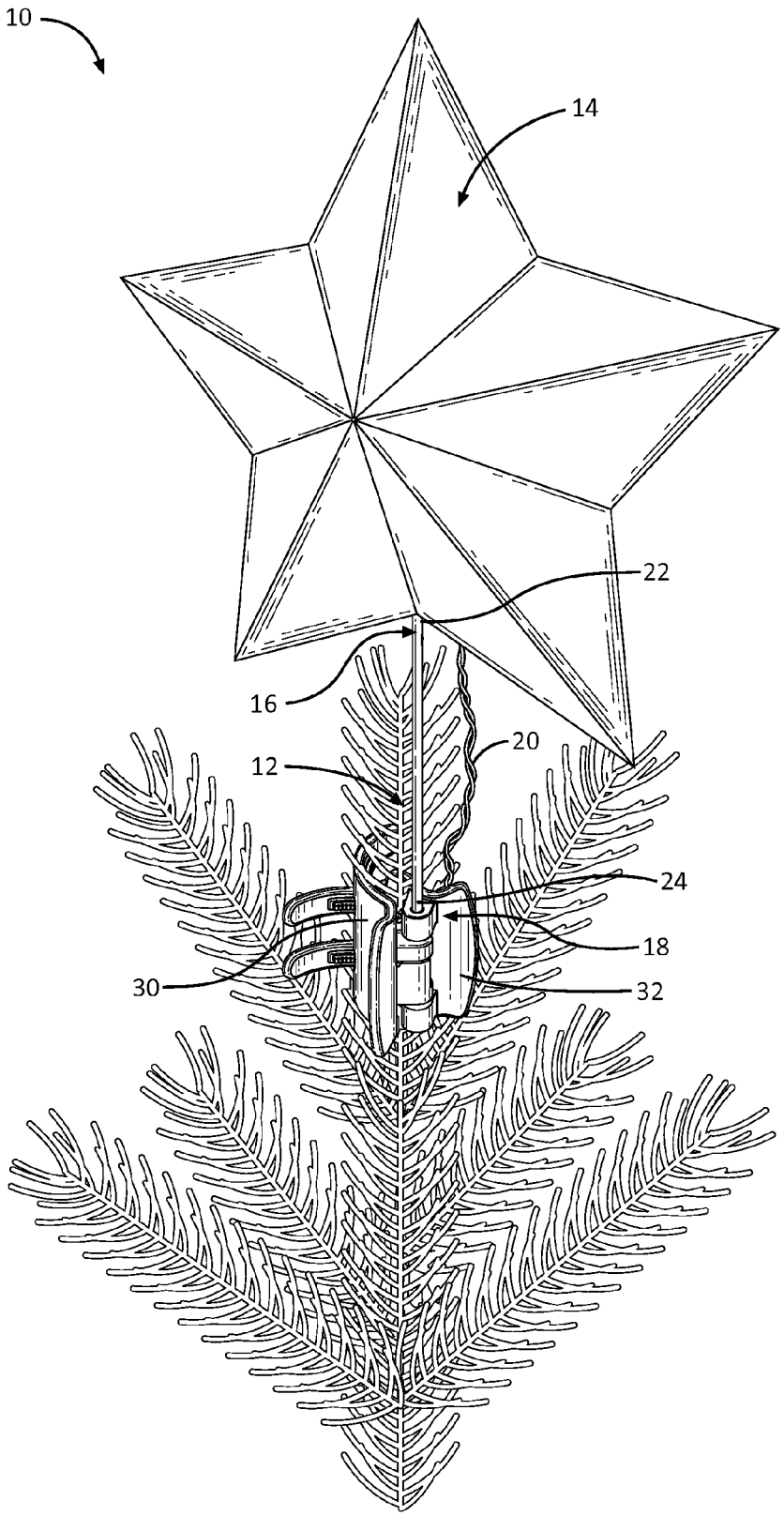
FIG. 1 is a front, perspective view illustration of an ornament with an attachment clip coupling the ornament to a tree branch, according to one embodiment of the present invention.
Figure 2:
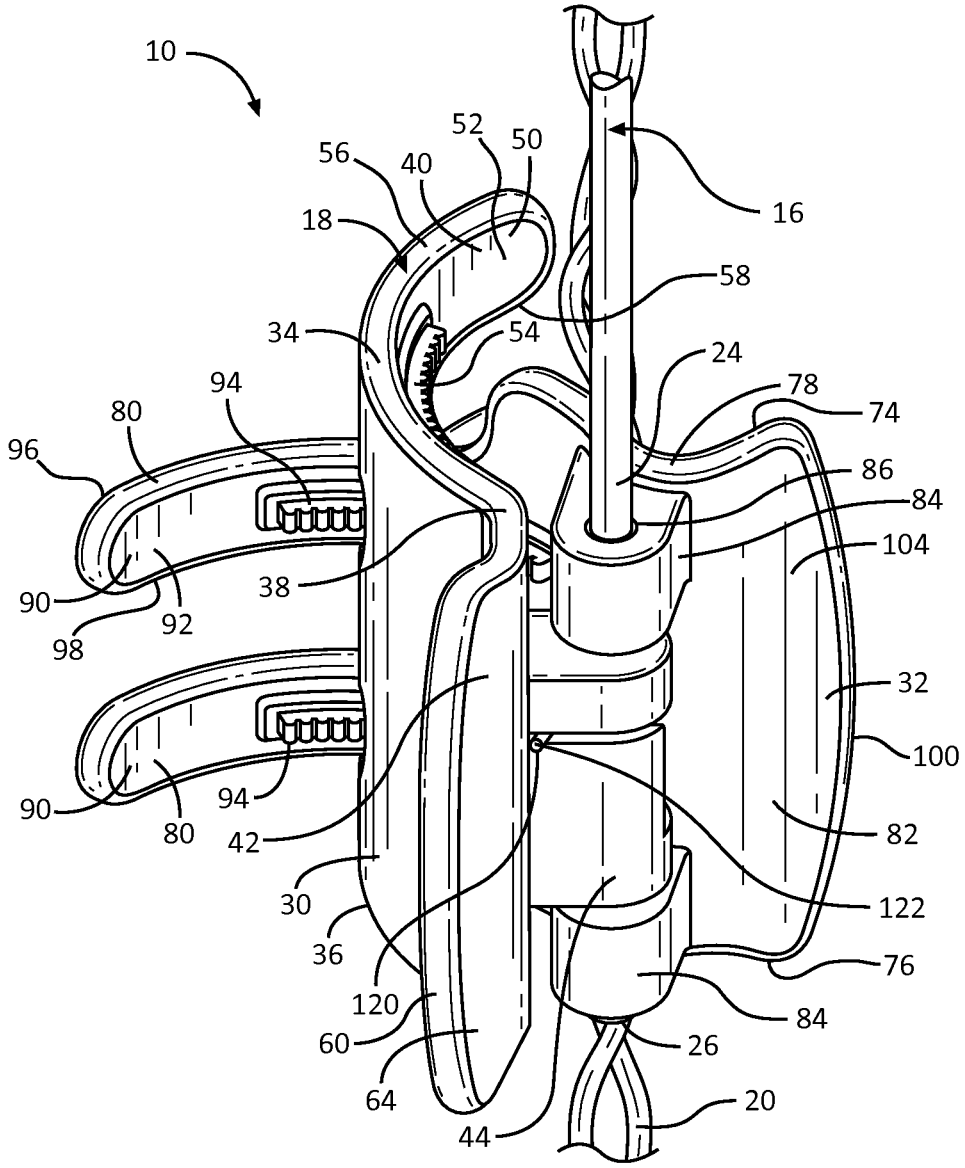
FIG. 2 is a perspective view illustration of the attachment clip of FIG. 1 in a closed position, according to one embodiment of the present invention.
Figure 3:
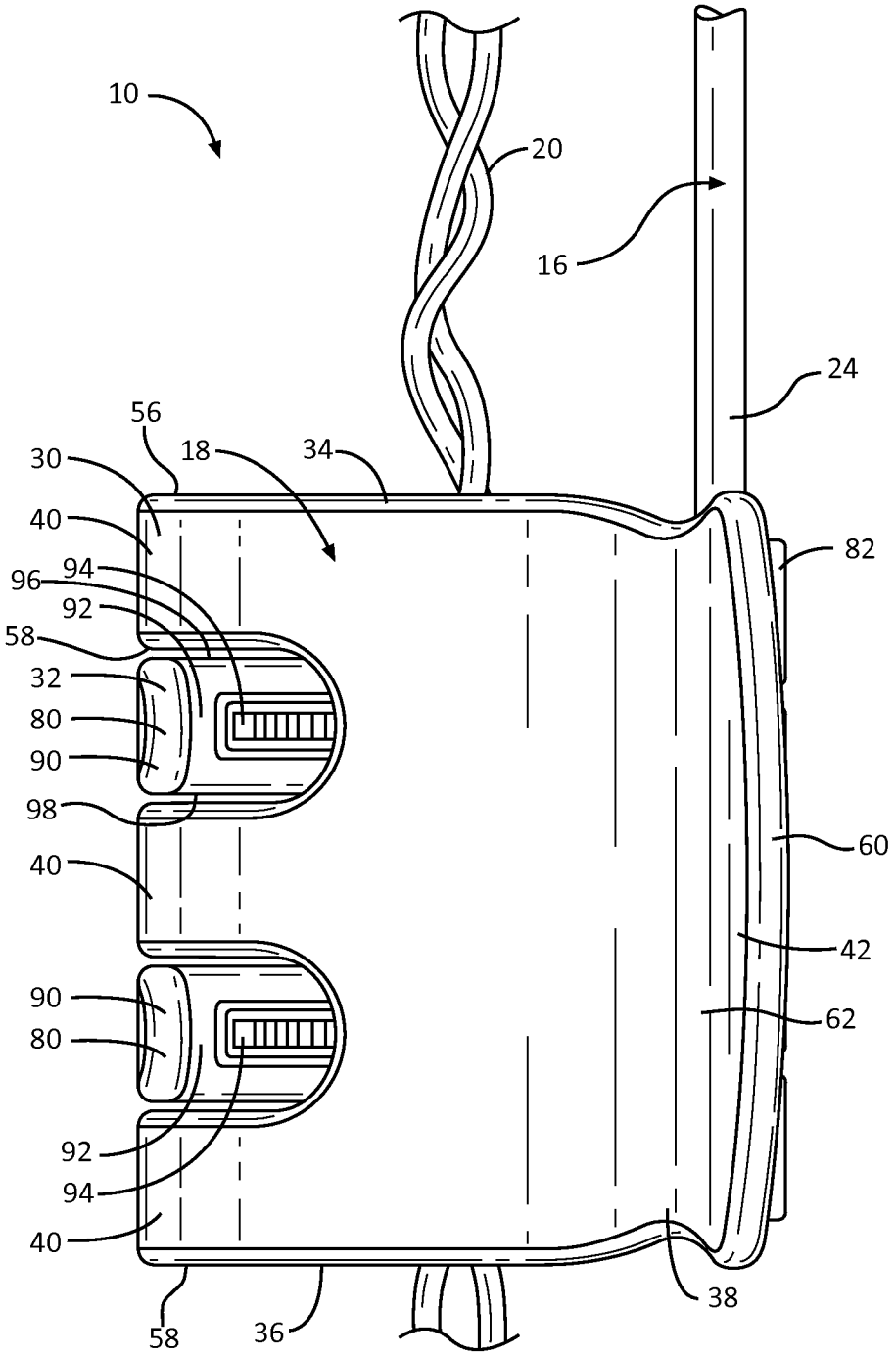
FIG. 3 is a front view illustration of the attachment clip of FIG. 1 in the closed position, according to one embodiment of the present invention.
Figure 4:
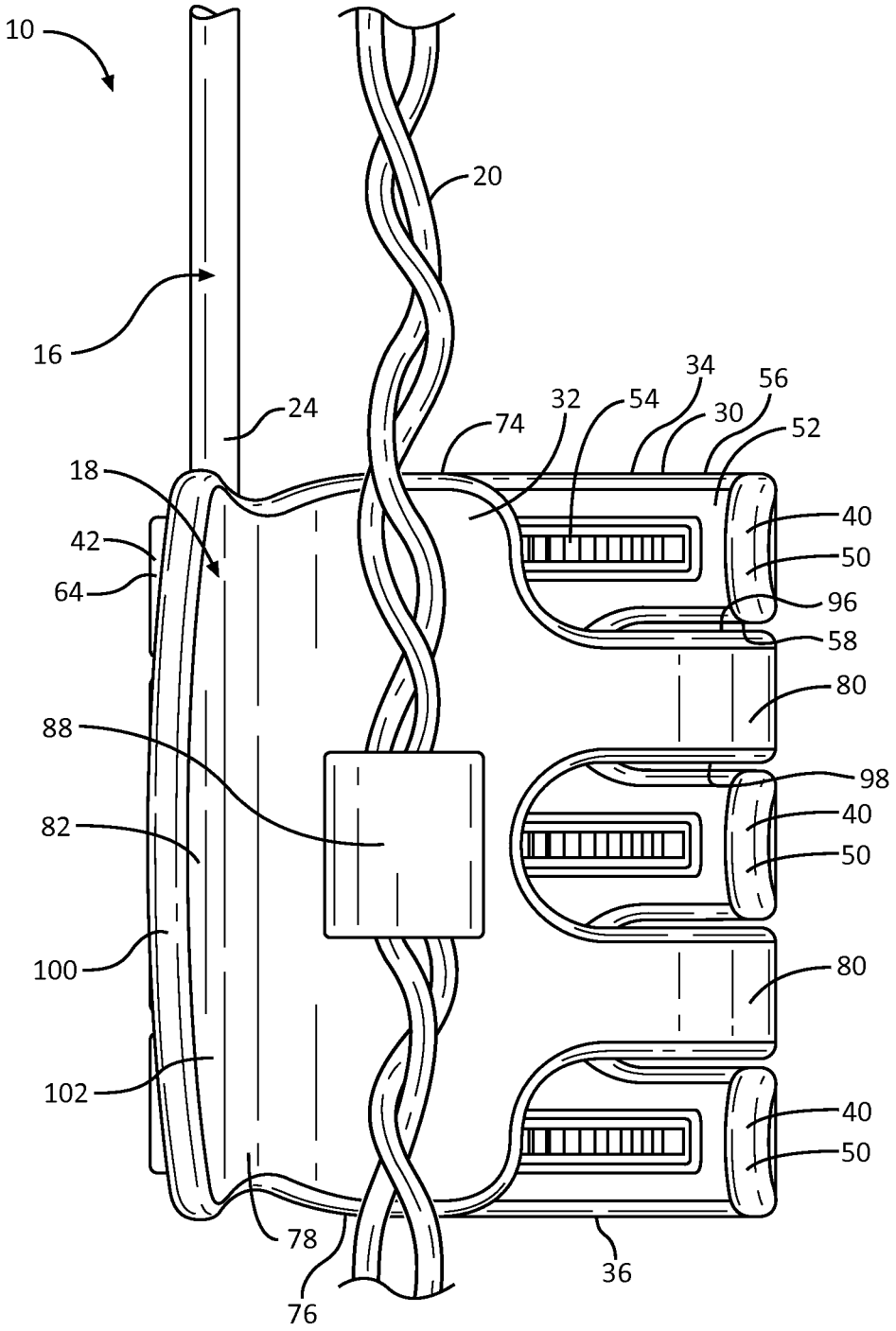
FIG. 4 is a rear view illustration of the attachment clip of FIG. 1 in the closed position, according to one embodiment of the present invention.
Figure 5:
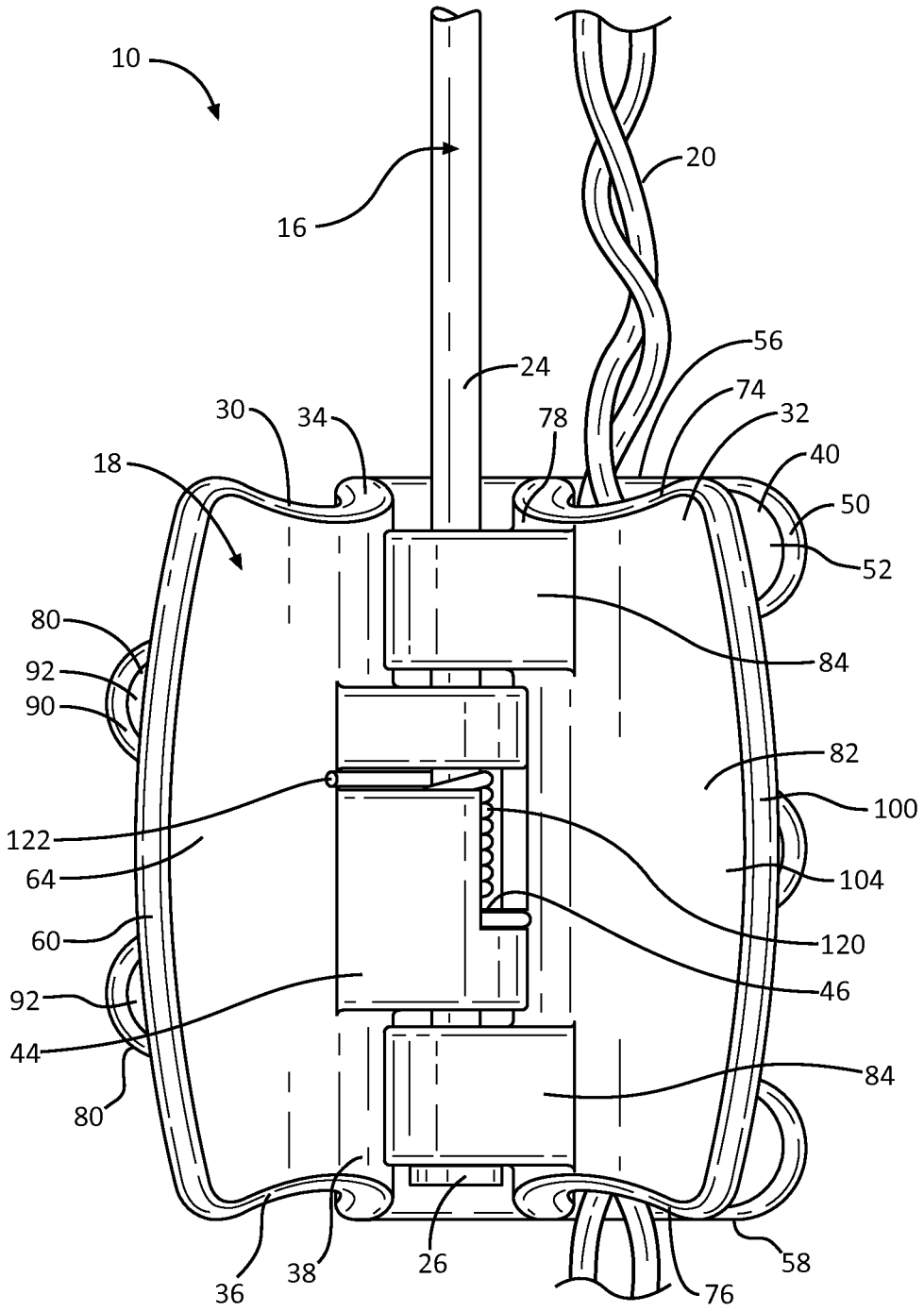
FIG. 5 is a right side view illustration of the attachment clip of FIG. 1 in the closed position, according to one embodiment of the present invention.
Figure 6:
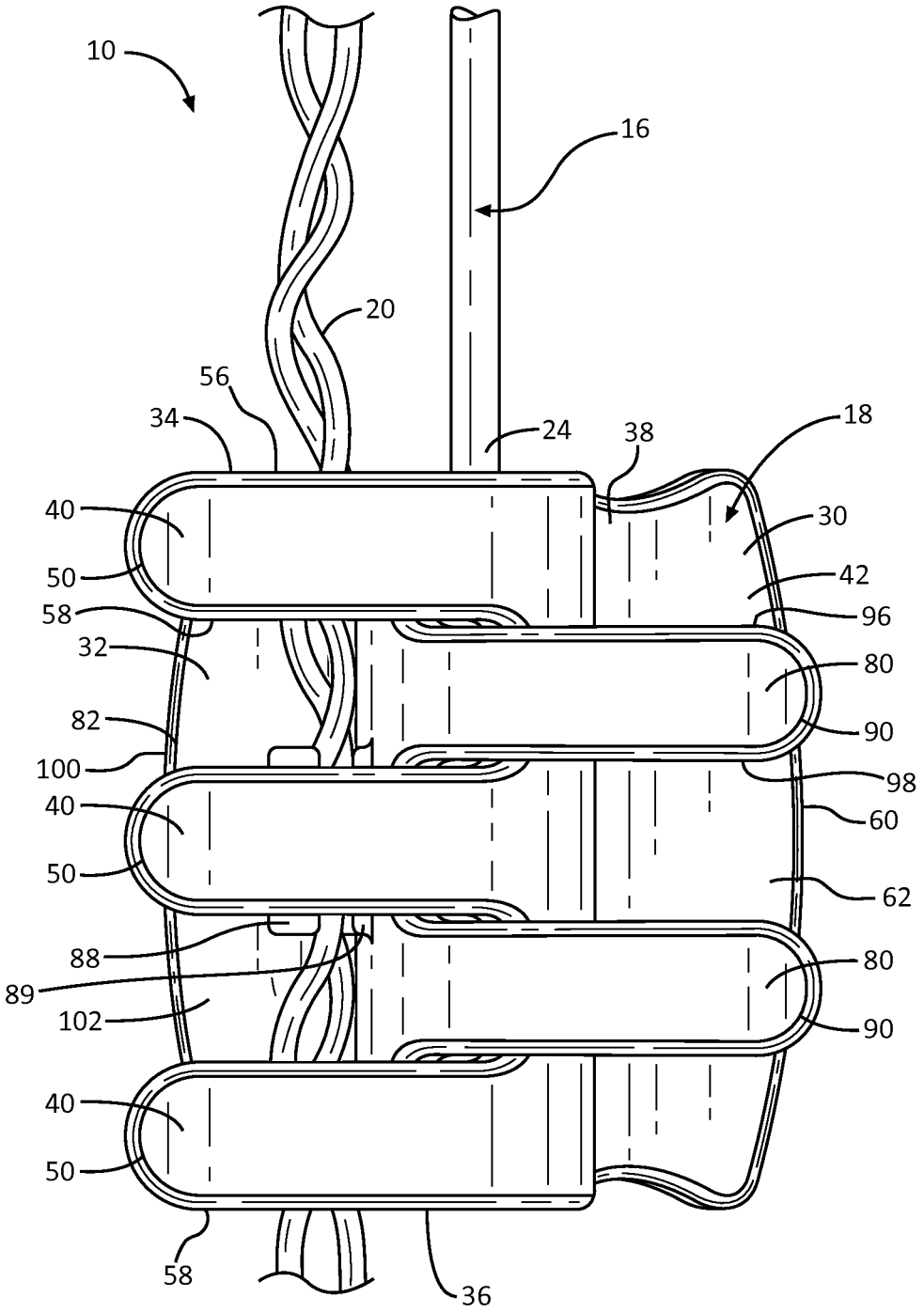
FIG. 6 is a left side view illustration of the attachment clip of FIG. 1 in the closed position, according to one embodiment of the present invention.

Turning to the Figures, FIG. 1 illustrates an ornament assembly 10 coupled to a support member, e.g., a tree branch 12. Ornament assembly 10 includes an ornament 14 or other decorative element, an elongated shaft 16, and an attachment clamp or clip 18. Ornament 14 is, in one example, a tree topper or other tree decoration such as a Christmas or another holiday decoration. In one example, ornament 14 includes lighting, sound, or other feature(s) (not shown) requiring electrical power such that ornament 14 includes an electrical cord 20 extending from any electrical feature thereof. In one embodiment, electrical cord 20 extends down from ornament 14 along elongated shaft 16 to an electrical plug or other power source interface (not shown) opposite ornament 14.

Elongated shaft 16 is a cylindrical or otherwise suitably shaped, substantially rigid rod, for example, formed as a single piece of plastic and/or metal with a continuous cross-sectional shape. Elongated shaft 16 extends between a first end 22 and a second end 24, which is opposite first end 22, to define a length as desired to space ornament 14 from its attachment to tree branch 12 via attachment clip 18. In one example, elongated shaft 16 has a length of between two inches and eighteen inches, such as between 6 inches and 12 inches depending on a type of ornament 14 and/or a desired end positioning of ornament 14. For instance, a length of elongated shaft 16 may be larger for a tree topper type of ornament 14 than for any ornament 14 configured for attachment to an interior tree branch 12. Elongated shaft 16 is sufficiently rigid so as to maintain its structural integrity while holding up ornament 14.

First end 22 of elongated shaft 16 is coupled to ornament 14, for example, by moving first end 22 of elongated shaft 16 into an opening or other reception portion (not shown) of ornament 14 for a friction fit coupling, via a suitable attachment mechanism or device, and/or in any other suitable manner. In one example, elongated shaft 16 includes a stop 26 at second end 24 that has a larger overall diameter than a remainder of elongated shaft 16. Stop 26 is configured to at least partially maintain a position of attachment clip 18, which extends around second end 24 of elongated shaft 16 following assembly, relative to elongated shaft 16 as will be further described below.

Figure 9:
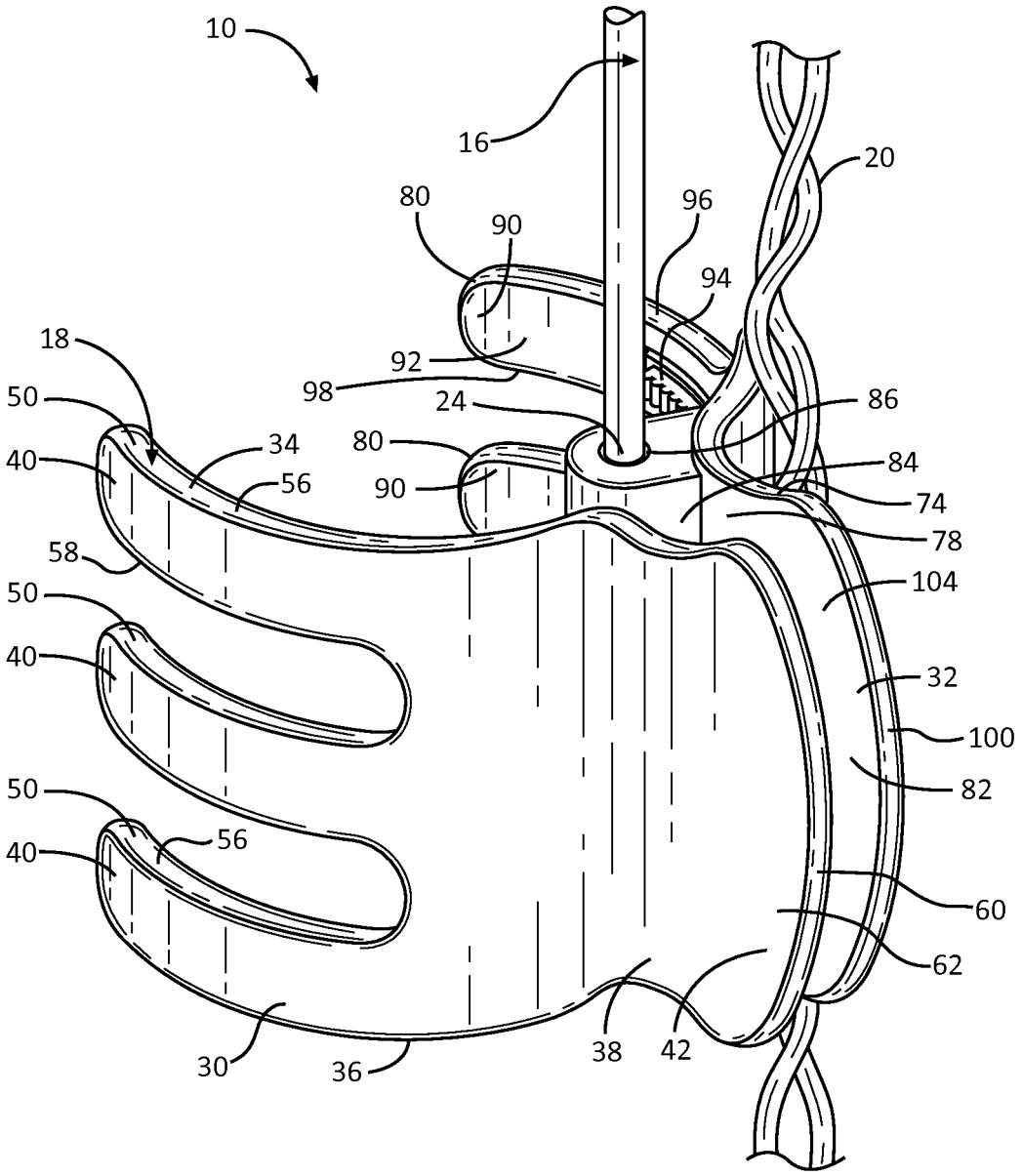
FIG. 9 is a perspective view illustration of the attachment clip of FIG. 1 in an open position, according to one embodiment of the present invention.
Figure 10:
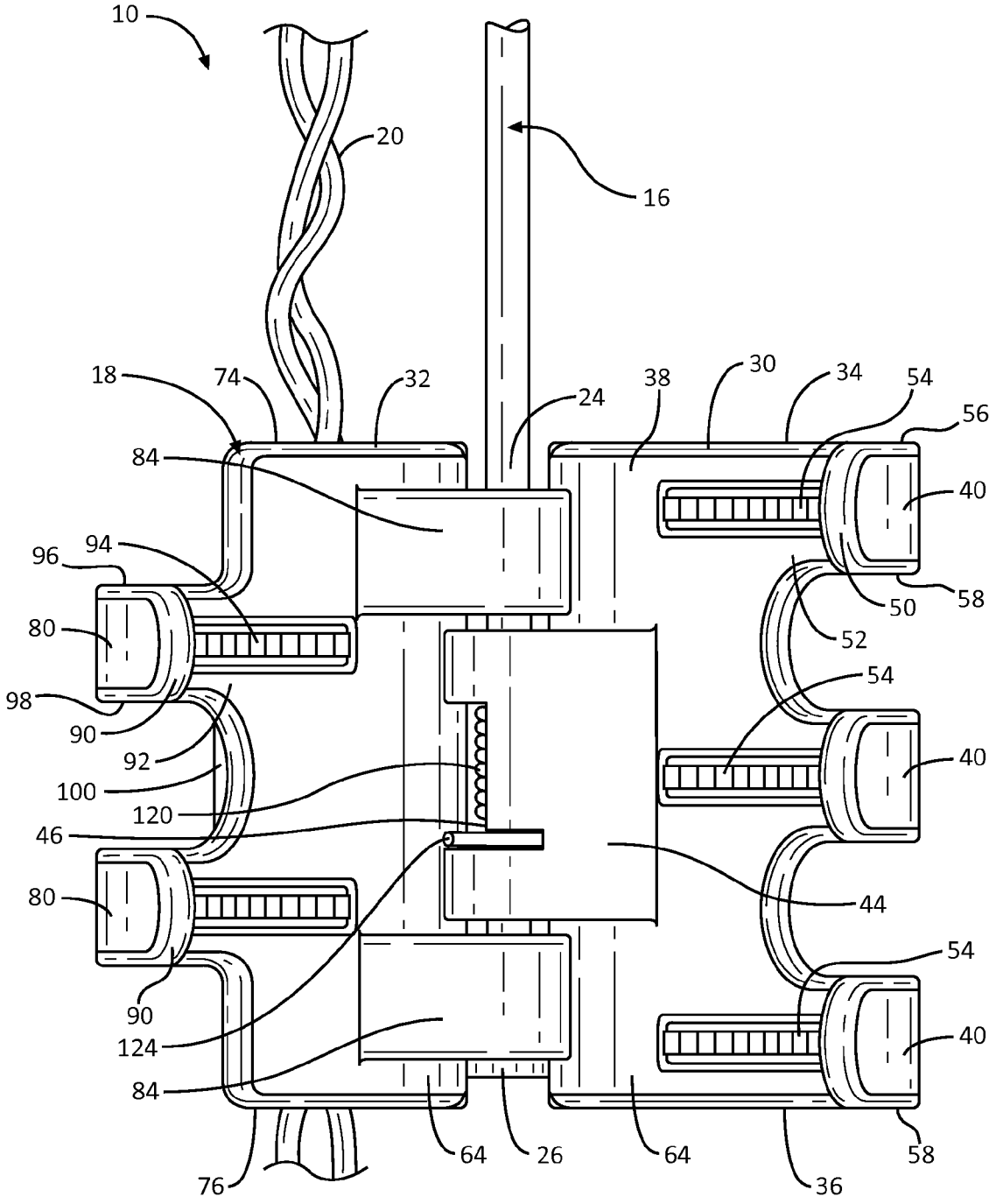
FIG. 10 is a left side view illustration of the attachment clip of FIG. 1 in a closed position, according to one embodiment of the present invention.
Figure 11:
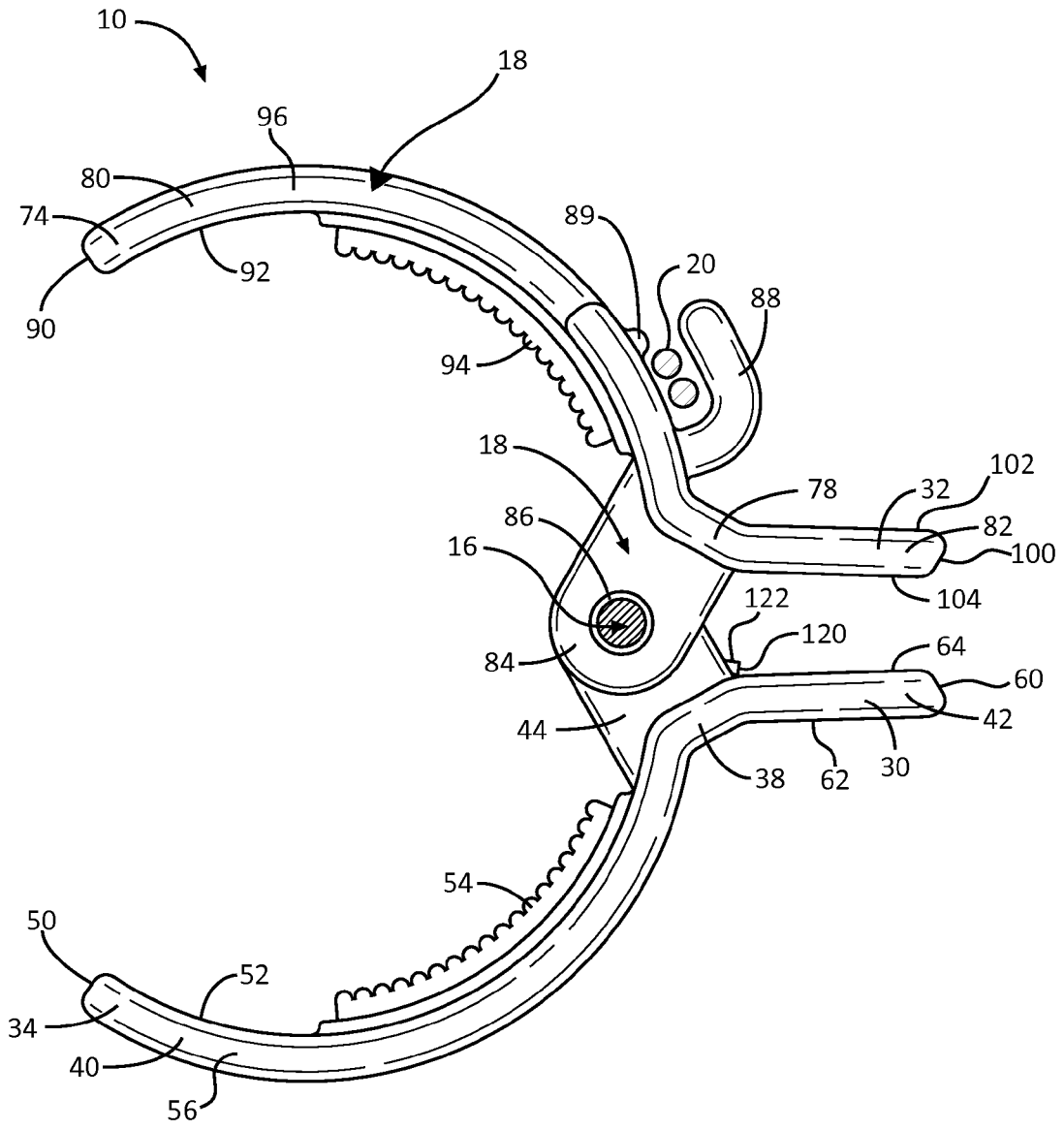
FIG. 11 is a top view illustration of the attachment clip of FIG. 1 in a closed position, according to one embodiment of the present invention.

Attachment clip 18 is configured to be coupled to second end 24 of elongated shaft 16 opposite first end 22, and therefore, opposite ornament 14. Upon assembly, attachment clip 18 selectively opens to receive and selectively closes to be clamped to tree branch 12. For example, FIGS. 2-8 illustrate a portion of ornament assembly 10 including attachment clip 18 in a clamped or closed position and FIGS. 9-11 show the same portion of ornament assembly 10 in a release or opened position. In one embodiment, attachment clip 18 includes a first member or first jaw 30 and a second member or second jaw 32 each hingedly coupled about second end 24 of elongated shaft 16. In this manner, elongated shaft 16 serves as an axle for rotation of first and second jaws 30 and 32 as well as a spacer between attachment clip 18 and ornament 14.

In one example, first jaw 30 defines a top edge 34 and a bottom edge 36 opposite top edge 34. First jaw 30 includes a spine 38, one or more fingers 40 (for example, two or more fingers 40), and a handle portion 42. Each of spine 38, fingers 40, and handle portion 42 vertically extend from top edge 34 to bottom edge 36. Spine 38 receives elongated shaft 20, and each of two or more fingers 40 and handle portion 42 extends in an opposite direction from spine 38.

In one example, spine 38 includes at least one protruding portion 44 extending inwardly from a remainder of spine 38 toward second end 24 of elongated shaft 20. More specifically, where first jaw 30 includes two or more protruding portions 62, each protruding portion 44 extends away from a remainder of spine 38 a substantially identical distance and/or extends substantially parallel to each other, according to one embodiment. The substantially identical distance is at least twice a diameter of elongated shaft 14, in one example. As illustrated in the figures, in one embodiment, spine 38 includes a single protruding portion 44. In one embodiment, the at least one protruding portion 44 is substantially centered between top edge 34 and bottom edge 36, however, other protruding portion 44 positions are also contemplated. Each protruding portion 44 further includes an aperture (not shown) substantially vertically extending therethrough and coaxially positioned relative to any other aperture(s) formed in a different one of protruding portions 44 of first jaw 30. In one example, one or more of protruding portions 44 includes a cutout 46 (see FIGS. 5 and 10) such that the one of protruding portions 44 does is not continuous from a top to a bottom edge thereof along elongated shaft 16, thereby, leaving a portion of elongated shaft 16 adjacent protruding portion 44 at least partially exposed.

First jaw 30 includes two or more fingers 40 extending in a curvilinear manner from the corresponding spine 38 to opposite free ends 50 thereof. Each finger 40 extends from spine 38 in an arched or curvilinear manner toward second jaw 32. Fingers 40 are each generally narrow and elongated. Fingers 40 are each substantially identical and are vertically or longitudinally offset from one another a distance at least equal to a height of each finger 40, in one embodiment. In one example, each finger 40 defines an internal surface 52 with at least a single linear row of teeth 54 extending along a portion of a length of the respective finger 40. In one embodiment, a different row of teeth 54 extends along a at least a majority, that is at least about fifty percent of a length of each finger 40, or, in one example, a substantial entirety of a length of each finger 40, for instance, at least sixty percent of the length of each of finger 40. Each tooth 50 is a projection being at least partially spaced from adjacent ones of teeth 54, in one embodiment. Additionally referring to the top view of FIG. 12 and as will be further described above, teeth 54 provide attachment clip 18 with a non-planar surface for grasping tree branch 12 in a more secure manner. Teeth 54 may each be rounded, pointed, or otherwise suitably shaped to provide an overall intermittent contact surface for interfacing with a support as will be further described below.

Figure 12:
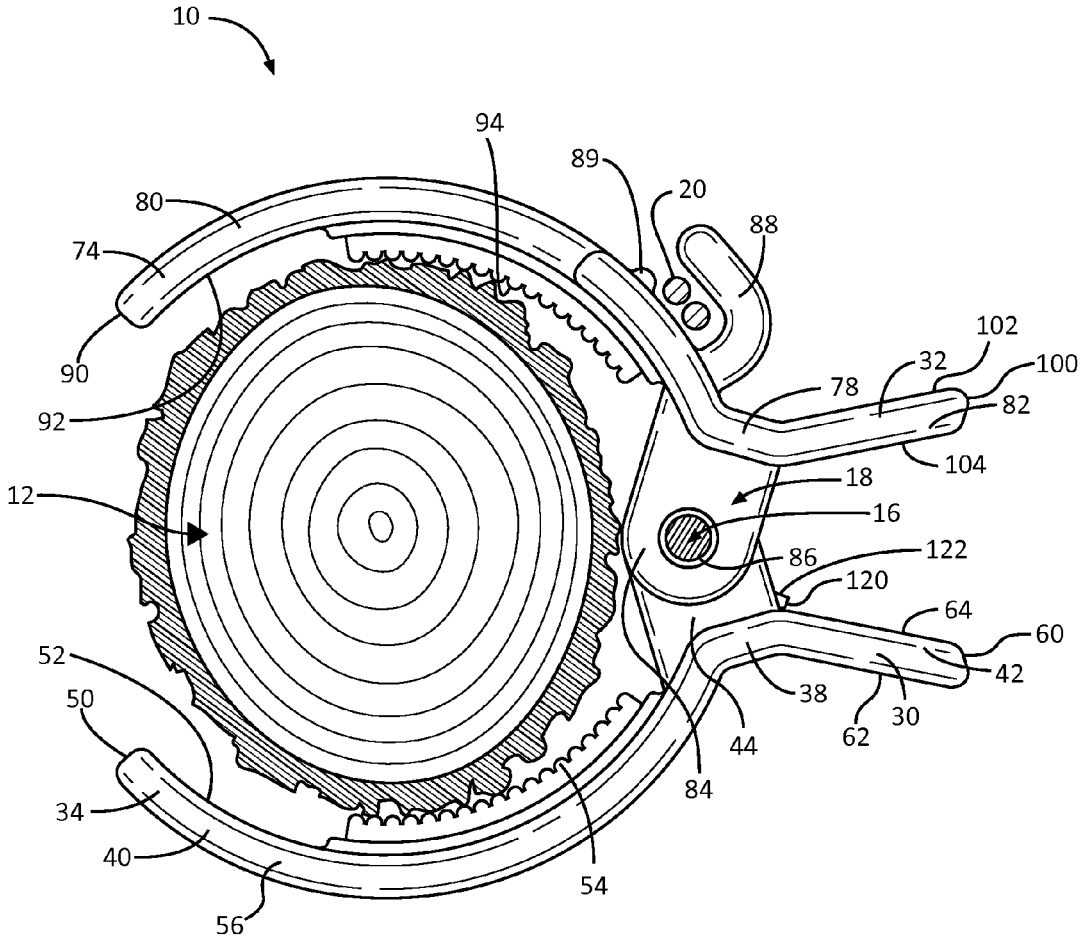
FIG. 12 is a top view illustration of the attachment clip of FIG. 1 clamped around a tree branch, according to one embodiment of the present invention.

Each of fingers 40 includes a top edge 56 and a bottom edge 58 opposite and, in one example, substantially parallel to top edge 56. In one example, top edge 56 of a topmost one of fingers 40 is substantially coterminous, and in one embodiment, collinear, with top edge 34 of first jaw 30 and/or bottom edge 58 of a bottommost one of fingers 40 is substantially coterminous, and in one embodiment, collinear, with bottom edge 36 of first jaw 30. The row of teeth 54 of each of fingers 40, in one example, extends substantially parallel to and is spaced from each of the corresponding top edge 56 and bottom edge 58. In one embodiment, the row of teeth 54 of each finger 40 is centered between each of the corresponding top edge 56 and corresponding bottom edge 58 of the corresponding finger 40. Such positioning of row of teeth 54 on each finger 40 places teeth 54 in an inconspicuous location and spaces the various rows of teeth 54 to provide for a rotationally and linearly secure coupling of attachment clip 18 to tree branch 12 (FIGS. 1 and 12).

Handle portion 42 of first jaw 30 extends away from spine 38 and, in one example, is curved, angled, flared, or otherwise transitioned outwardly in a direction away from fingers 40 and away from second jaw 32, as considered upon assembly of attachment clip 18, to a longitudinally extending free edge 60. Since handle portion 42 is positioned on an opposite side of spine 38 relative to fingers 40, handle portion 42 is configured for user interaction therewith such that user interaction with handle portion 42 causes corresponding inverse movement of fingers 40 as first jaw 30 is rotated about elongated shaft 16. For instance, as handle portion 42 of first jaw 30 is moved toward the second jaw 32, fingers 40 of first jaw 30 move away from second jaw 32. In this manner handle portion 42 may be formed in any suitable manner to encourage easy user interaction therewith to manipulated fingers 40 of attachment clip 118 during use. In one example, handle portion 42 presents a broad and angular planar external surface 62 for easy grasping or pushing by a user. Handle portion 42 additionally defines an internal surface 64 opposite external surface 62 and facing second jaw 32.

In one example, second jaw 32 has largely similar structure as first jaw 30 other than the specific differences noted below and illustrated in the figures. Second jaw 32 defines a top edge 74 and a bottom edge 76 opposite top edge 74. In one embodiment, second jaw 32 includes a spine 78, one or more fingers 80 (for example, two or more fingers 80), and a handle portion 82. Each of spine 78 and handle portion 82 vertically extend from top edge 74 to bottom edge 76, and in one example, each of the two or more fingers 80 are offset from both of top edge 74 and bottom edge 76. Spine 78 receives elongated shaft 20, and each of two or more fingers 80 and handle portion 82 extends in an opposite direction from spine 78.

In one example, spine 78 includes at least one protruding portion 84, for instance, as illustrated at least two protruding portions 84, extending inwardly from a remainder of spine 78 toward second end 24 of elongated shaft 20. More specifically, where second jaw 32 includes two or more protruding portions 102, each protruding portion 84 extends away from a remainder of spine 78 a substantially identical distance and/or extends substantially parallel to each other, according to one embodiment. The substantially identical distance is at least twice a diameter of elongated shaft 16, in one example. In one embodiment, the at two protruding portions 84 are collectively substantially centered between top edge 74 and bottom edge 76; however, other protruding portion 84 positions are also contemplated. In one example, the two protruding portions 84 are spaced from each other a distance substantially equal to but greater than a height of protruding portion 44 of first jaw 30. Each protruding portion 84 further includes an aperture 86 (see, e.g., FIG. 2) substantially vertically extending therethrough and coaxially positioned relative to any other aperture formed in a different one of protruding portions 84 of second jaw 32 and, upon assembly, to a corresponding aperture (not shown) in a protruding portion 44 of first jaw 30.

In one example, spine 78 additionally includes an external hook 88 extending from a surface of spine 78 opposite the at least one protruding portion 84. Hook 88 extends outwardly from a remainder of spine 78 and then over and spaced from a portion of the surface to form a cavity for receiving any cord 20 that extends from ornament 14, for example, where ornament 14 makes use of electricity for lights, sound, or other effects. In one embodiment, an additional bump or protruding nub 89 is formed near an open end of hook 88 and extends outwardly from outer surface of spine 78 to further facilitate maintenance of cord 20 in hook 88. Hook 88 holds cord 20 close to elongated shaft 16 and attachment clip 18, thereby, holding cord 20 close to tree branch 12 such that it is largely hidden from obvious viewing and/or does not provide other substantial aesthetic detraction to the decorated tree or other area. As such, not only does attachment clip 18 hold ornament 14 to tree branch 12, but attachment clip 18 also aids in hiding cord 20 or at least diminishing the visual impact of cord 20 on tree branch 12 and/or ornament. While primarily described and illustrated as being included on second jaw 32, in one example, external hook 88 and/or protruding nub 89 are additionally or alternatively included on first jaw 30, for example, adjacent spine 38.

Second jaw 32 includes two or more fingers 80 extending in a curvilinear manner from the corresponding spine 78 to opposite free ends 90 thereof. Each finger 80 extends from spine 78 in an arched or curvilinear manner toward first jaw 30. Fingers 80 are each generally narrow and elongated. Fingers 80 are each substantially identical and are vertically or longitudinally offset from one another a distance at least equal to a height of each finger 40. In one example, each finger 80 defines an internal surface 92 with at least a single linear row of teeth 94, for example, teeth 94 that are substantially identical to teeth 54, extending along a portion of a length of the respective finger 80 and 82. In one embodiment, a different row of teeth 94 extends along a at least a majority, that is at least about fifty percent of a length of each finger 80, or, in one example, a substantial entirety of a length of each finger 80, for instance, at least sixty percent of the length of each of finger 80. Each tooth 94 is a projection being at least partially spaced from adjacent ones of teeth 94, in one embodiment. Additionally referring to the top view of FIG. 12 and as will be further described above, teeth 94 provide attachment clip 18 with a non-planar surface for grasping tree branch 12 or other support in a more secure manner. Teeth 94 may each be rounded, pointed, or otherwise suitably shaped to provide an overall intermittent contact surface for interfacing with a support, as will be further described below. In one example, teeth 54 and 94 are substantially identical.

Each of fingers 80 includes a top edge 96 and a bottom edge 98 opposite and, in one example, substantially parallel to top edge 96. In one example, top edge 96 of a topmost one of fingers 80 is offset from top edge 74 of second jaw 32 toward bottom edge 76 of second jaw 32, and/or bottom edge 98 of a bottommost one of fingers 80 is offset from bottom edge 76 of second jaw 32 toward top edge 74 of second jaw 32. The row of teeth 94 of each of fingers 80, in one example, extends substantially parallel to and is spaced from each of the corresponding top edge 96 and bottom edge 98. In one embodiment, the row of teeth 94 of each finger 80 is centered between each of the corresponding top edge 96 and corresponding bottom edge 98 of the corresponding finger 80. Such positioning of row of teeth 94 on each finger 80 places teeth 94 in an inconspicuous location and spaces the various rows of teeth 94 and 54 to provide for rotationally and linearly secure coupling of attachment clip 18 to tree branch 12 (FIGS. 1 and 12).

Handle portion 82 of second jaw 32 extends away from spine 78 and, in one example, is curved, angled, flared, or otherwise transitioned outwardly in a direction away from fingers 80 and away from second jaw 32, as considered upon assembly of attachment clip 18, to a longitudinally extending free edge 100. Since handle portion 82 is positioned on an opposite side of spine 78 relative to fingers 80, handle portion 82 is configured for user interaction therewith such that user interaction with handle portion 82 causes corresponding inverse movement of fingers 80 as first jaw 30 is rotated about elongated shaft 16. For instance, as handle portion 82 of second jaw 32 is moved toward first jaw 30, fingers 80 of second jaw 32 move away from first jaw 30. In this manner, handle portion 82 may be formed in any suitable manner to encourage easy user interaction therewith to manipulate fingers 80 of attachment clip 18 during use. In one example, handle portion 82 presents a broad and angular planar external surface 102 for easy grasping or pushing by a user. Handle portion 82 additionally defines an internal surface 104 opposite external surface 102 and facing second jaw 32.

In one embodiment, sliding each of first jaw 30, second jaw 32, and ornament 14 onto elongated shaft 16 assembles ornament assembly 10. In one example, first jaw 30 and second jaw 32 are aligned within one another prior to being placed on elongated shaft 16. More specifically, protruding portion 44 of first jaw 30 is placed between the two protruding portions 84 of second jaw aligning any apertures (e.g., apertures 86) with the apertures in the other protruding portions 44 and 84. In other examples, protruding portions 44 and 84 may otherwise be configured relative to one another while remaining adjacent to the other of protruding portions 44 and 84 or are otherwise configured as will be apparent to those of skill in the art after reading this application. When protruding portions 44 and 84 are so arranged, fingers 40 and 80 are positioned to be interposed between one another in an alternating configuration, for example, as illustrated in the figures.

In one embodiment, a coil spring 120 is placed to axially align with apertures in protruding portions 44 and 84. Coil spring 120 includes two free ends 122 (see, e.g., FIGS. 2 and 5) and 124 (FIG. 10) on opposite ends of the coiled portion of coil spring 120 and each extends in a radially opposing direction relative to the other to interact with a different one of first jaw 30 and second jaw 32. Coil spring 120 is, in one example, placed substantially within cutout 46 of protruding portion 44 of first jaw 30 such that the two free ends 122 and 124 extend out of cutout 46 to each interface with a different one of internal surface 64 of first jaw 30 and internal surface 104 of second jaw 32. In this manner, coil spring 120 is configured to bias fingers 40 of first jaw 30 toward fingers 90 of second jaw 30 and 32 such that fingers 40 and 80 are fully interposed and extend through gaps or voids of the other of first jaw 30 and second jaw 32 defined between adjacent fingers 40 or 80 thereof. In other embodiment, other types of springs or biasing mechanism(s) are used as an alternative to or in addition to coil spring 120.

When first jaw 30, second jaw 32, and coil spring 120 are aligned with one another, elongated shaft 16 is slid through apertures, for example, aperture 66, in protruding portions 44 and 84 of first and second jaws 30 and 32 and through a center of the coiled portion of coil spring 120. First end 22 of elongated shaft 16 may be thread through the apertures of attachment clip 18 as described above and may be continually moved therethrough until one or both of bottom edges 36 and/or 76 contact stop 26, which caps second edge 24 of elongated shaft 16. In other embodiments, second end 124 of elongated shaft 16 is thread through first jaw 30, second jaw 30, and coil spring 120, with stop 26 being added to elongated shaft 16 after such threading. In one example, coil spring 120 is tightly wound around elongated shaft 16 in a manner also maintaining the longitudinal placement of attachment clip 18 relative to elongated shaft 16. Other stops or positioning devices may be additionally or alternatively used to secure attachment clip 18 longitudinally in place relative to elongated shaft 16.

Either before or after attachment clip 18 is secured about elongated shaft 16, ornament 14 is statically or otherwise suitably secured to first end 22 of elongated shaft 16. Ornament 14 may be frictionally secured to first end 22 and/or secured to first end 22 with adhesive, welding, plastics, or other fasteners as will be apparent to those of skill in the art. In one example, elongated shaft 16 maintains ornament 14 spaced above attachment clip 18 a distance at least equal to an height of attachment clip 18, for instance, a distance at least equal to twice a height of attachment clip 18. In one embodiment, ornament is only coupled to attachment clip 18 via elongated shaft 16.

In one embodiment, ornament 14 may be animated or otherwise coupled to elongated shaft 16 to allow rotation or other appropriate movement of ornament 14 relative to elongated shaft 16. In one embodiment, where ornament 14 includes an electrical component, cord 20 of ornament 14 is tucked between spine 78 and external hook 88 to maintain cord 20 close to elongated shaft 16 in a manner decreasing any detrimental impact of the cord 20 on the overall aesthetic presentation of ornamental assembly 10. In one example, placing cord 20 between spine 78 and external hook 88 includes pushing cord 20 over protruding nub 89 and into the void between spine 78 and external hook 88 such that cord 20 is less likely to be inadvertently pulled from its storage position.

Upon construction, ornament assembly 10 is ready for use. A support structure such as tree branch 12 as illustrated in FIGS. 1 and 12 is selected as a desired place for coupling ornament 14 thereto. In one example, support structure is substantially circular in cross-section; however, other shaped support structures may also be selected to support ornament assembly 10.

Additionally referring to the top view of FIG. 12, teeth 54 of first jaw 30 and teeth 94 of second jaw 32 each provide attachment clip 18 with an intermittent and non-planar surface for grasping tree branch 12 or other support structure. In this manner, teeth 54 and 94 facilitate forming a more secured coupling of attachment clip 18 with tree branch 12, thereby, decreasing at least vertical slippage of attachment clip 18 and all of ornament assembly 10 along tree branch 12. As previously described, each of first jaw 30 and second jaw 32 rotates about elongated shaft 16 relative to the other of first jaw 30 and second jaw 32 and fingers 40 and 80, thereof, are biased toward each other in the closed position of FIGS. 1-8. In one example, rather than both of first jaw 30 and second jaw 32 rotating about elongated shaft 16, only one of first jaw 30 and second jaw 32 rotates about elongated shaft 16 and the other of first jaw 30 and second jaw 32 is statically coupled with elongated shaft 16.

Figure 7:
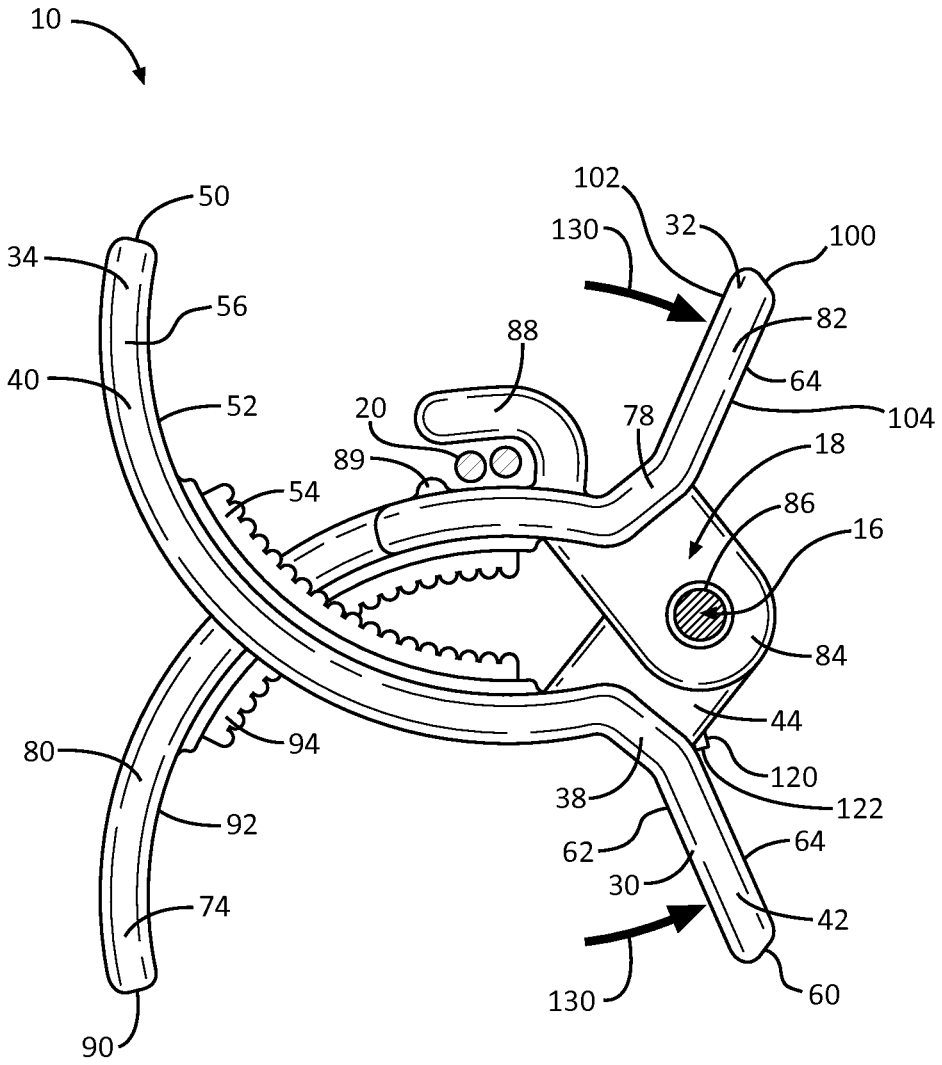
FIG. 7 is a top view illustration of the attachment clip of FIG. 1 in the closed position, according to one embodiment of the present invention.
Figure 8:
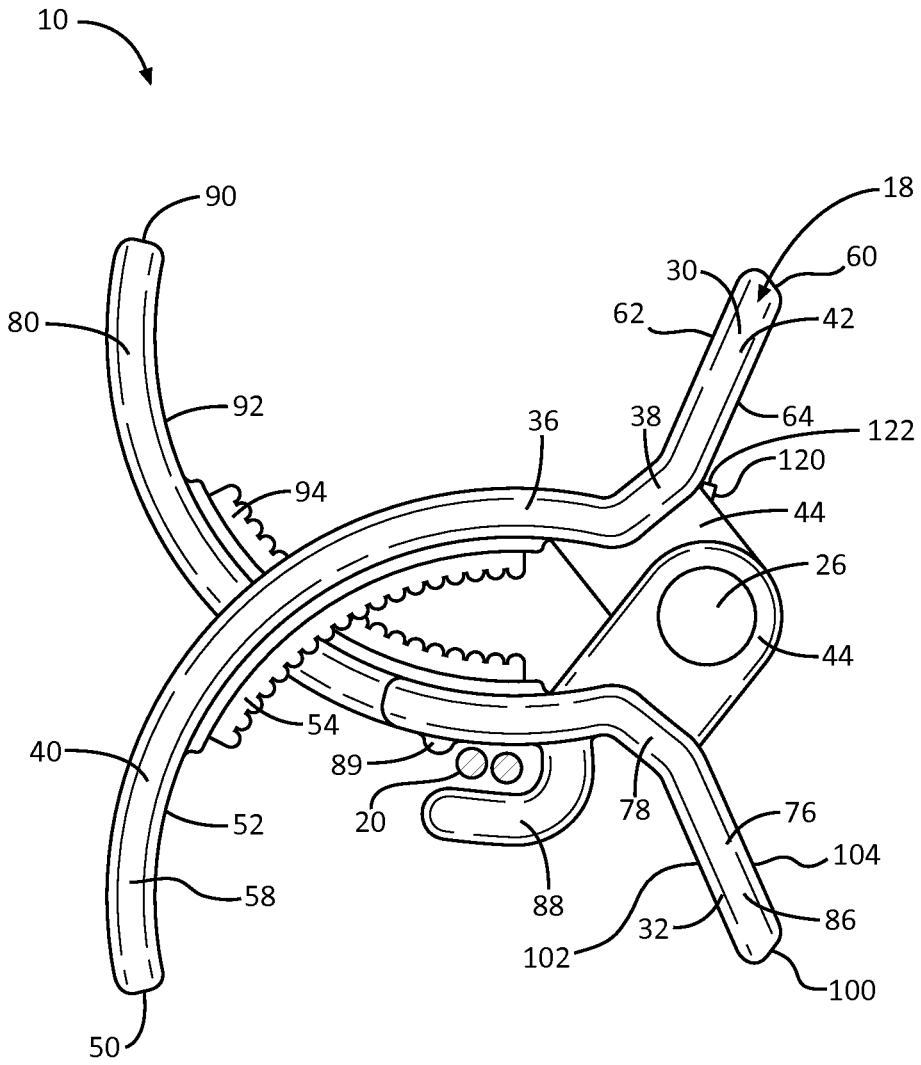
FIG. 8 is a bottom view illustration of the attachment clip of FIG. 1 in the closed position, according to one embodiment of the present invention.

To couple ornament assembly with tree branch 12, opposing forces, which are generally indicated by arrows 130 in FIG. 7, are applied to handle portions 42 and 82 of first and second jaws 30 and 32 to push handle portions 42 and 82 toward each other. As handle portions 42 and 82 are moved toward each other, fingers 40 and 80 of first jaw 30 and second jaw 32 move apart from one another to transition the attachment clip 18 to the open position of FIGS. 9-11. While in the open position, attachment clip 18 can be relatively easily placed over tree branch 12 or other suitable support structure.

When attachment clip 18 is in the desired position to place ornament 14 at the desired height and rotation relative to tree branch 12, opposing forces 130 (FIG. 7) are removed from first jaw 30 and second jaw 32, such that the bias imparted on first jaw 30 and second jaw 32 by coil spring 120 moves attachment clip 18 back toward its closed position of FIGS. 1-8. Referring to FIG. 12, first and second jaws 30 and 32, more specifically, rows of teeth 54 and 94, contact outside surfaces of tree branch 12 in a manner stopping attachment clip 18 from returning completely to the fully closed position of FIGS. 1-8. Rather, the biasing force from coil spring 120 clamps rows of teeth 52 and 94 around tree branch 12 securing ornament assembly 10 to tree branch 12 in a secure and substantially static manner. In one embodiment, upon positioning, tree branch 12 and elongated shaft 16 extend substantially parallel to one another. Finally, cord 20 is plugged into a power source in embodiments wherein ornament 14 includes an electrical component to power ornament 14.

The curvilinear and selectively interposed fingers 40 and 80 and teeth 54 and 94 of attachment clip 18 provide ornament assembly 10 with flexibility for use with a relatively large variety of sizes of tree branches 12 or other supports. More specifically, as illustrated in FIG. 12, the curvature of fingers 50 and 80 and rows of teeth 54 and 94 allow for significant contact between rows of teeth 54 and 94 and curved outer surfaces of tree branch 12 even where tree branch 12 is sufficiently large to maintain free ends 50 of fingers 40 spaced from free ends 90 of fingers 80. As will be appreciated by those of skill in the art upon reading this application the amount of contact between teeth 54 and 94 wrapped around tree branch 12 is much greater than for linear fingers or teeth arrangements of prior art clips. The increased contact between fingers 40 and 80 and tree branch 12 provides for a more secure coupling of attachment clip 18 and all of ornament assembly 10 to tree branch 12 at least decreasing vertical slippage of attachment clip 10 and all of ornament assembly 10 along tree branch 12.

Figure 13:
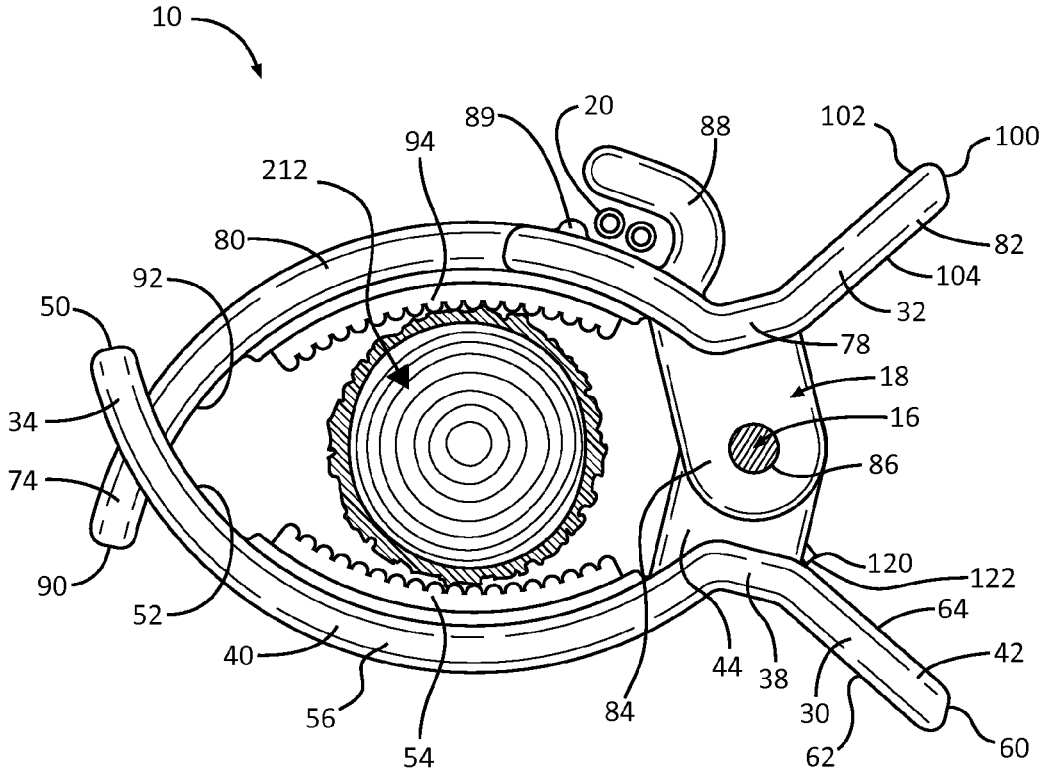
FIG. 13 is a top view illustration of the attachment clip of FIG. 1 clamped around a tree branch, according to one embodiment of the present invention.

The interposed fingers 40 and 80 also increase effectiveness of attachment clip 18 over a wide range of support sizes. For example, referring to FIG. 13, when attachment clip 18 is used with a tree branch 212 that is smaller than tree branch 12 of FIG. 12, the interposed arrangement of fingers 40 and 80 allows free ends 50 of fingers 40 to pass through voids between fingers 80 and free ends 90 of fingers 80 to pass through voids between fingers 40. This movement, as opposed to prior art clips where free edges 50 and 90 would contact each other in a manner preventing further movement of free edges 50 and 90 toward and beyond one another, allows teeth 54 and 94 of attachment clip 18 to also contact outside surfaces of a significantly smaller tree branch 212, thereby, increasing the functionality and overall usefulness of attachment clip 18. The curvature of fingers 40 and 80 additionally increases securement of attachment clip 18 on branch 212 even where fingers 40 and 80 are at least partially interposed with one another as shown in FIG. 13.

Although the invention has been described with respect to particular embodiments, such embodiments are meant for illustrative purposes only and should not be considered to limit the invention. Various alternatives and changes will be apparent to those of ordinary skill in the art upon reading this application. Other modifications within the scope of the invention and its various embodiments will be apparent to those of ordinary skill.

What is claimed is:

1. An ornament assembly comprising:

an attachment clip including:

a first jaw including a first spine and a first finger curvilinearly extending from the first spine, and a second jaw including a second spine and a second finger curvilinearly extending from the second spine toward the first finger;

an elongated shaft including a first end and a second end opposite the first end, wherein the second end of the elongated shaft is coupled to each of the first spine and the second spine such that at least one of the first jaw and the second jaw rotates about the elongated shaft to move the attachment clip between an open position, in which the first finger and the second finger are spaced from one another, and a closed position, in which the first finger and the second finger are positioned adjacent one another; and an ornament coupled to the first end of the elongated shaft such that the ornament is spaced from the attachment clip via a length of the elongated shaft;

wherein:

the first finger is one of at least two first fingers, and when the at least one of the first jaw and the second jaw are in the closed position, the at least one second finger is interposed between the at least two first fingers.

2. The ornament assembly of claim 1, wherein:

the first spine includes at least one first protrusion extending inwardly from a remainder of the first spine, the second spine includes at least one second protrusion extending inwardly from a remainder of the second spine, the first jaw is positioned relative to the second jaw to align the at least one first protrusion with the at least one second protrusion, and the elongated shaft extends through each of the at least one first protrusion and the at least one second protrusion such that the first jaw and the second jaw are rotatably coupled to one another via the elongated shaft.

3. The ornament assembly of claim 2, further comprising a spring coiled around the elongated shaft and interacting with each of the first jaw and the second jaw to bias the at least one of the first jaw and the second jaw in the closed position.

4. The ornament assembly of claim 1, wherein:

the first finger defines a first internal surface and includes a single row of first teeth extending along at least a majority of a first length of the first finger, and each tooth in the row of first teeth extends inwardly from the first internal surface.

5. The ornament assembly of claim 4, wherein:

the second finger defines a second internal surface and includes a row of second teeth extending along at least a majority of a length of the second finger, and each tooth in the row of second teeth extends inwardly from the second internal surface.

6. The ornament assembly of claim 4, wherein the single row of first teeth is centered between two opposing elongated edges of the first finger such that each tooth in the single row of first teeth is spaced from the two opposing elongated edges of the first finger.

7. The ornament assembly of claim 1, wherein:

the second finger defines an internal surface and includes a row of teeth extending along a substantial entirety of a length of the second finger, and each tooth in the row of teeth extends inwardly from the internal surface.

8. The ornament assembly of claim 1, wherein the elongated shaft maintains the ornament spaced above the attachment clip a distance at least equal to a height of the attachment clip.

9. The ornament assembly of claim 1, wherein the elongated shaft maintains the ornament spaced above the attachment clip a distance at least equal to twice a height of the attachment clip.

10. The ornament assembly of claim 1, wherein the ornament is coupled to the first jaw and the second jaw only via the elongated shaft.

11. The ornament assembly of claim 1, wherein:

a void is defined between the at least two first fingers, and when the attachment clip is in the closed position, the second finger extends through the void to an opposite side of the first jaw.

12. The ornament assembly of claim 1, wherein the elongated shaft has a continuous cross-sectional shape from the first end to the second end.

13. An ornament assembly comprising:

an attachment clip including:

a first jaw including a first spine and a first finger curvilinearly extending from the first spine, and a second jaw including a second spine and a second finger curvilinearly extending from the second spine toward the first finger;

an elongated shaft including a first end and a second end opposite the first end, wherein the second end of the elongated shaft is coupled to each of the first spine and the second spine such that at least one of the first jaw and the second jaw rotates about the elongated shaft to move the attachment clip between an open position in which the first finger and the second finger are spaced from one another, and a closed position in which the first finger and the second finger are positioned adjacent one another; and an ornament coupled to the first end of the elongated shaft such that the ornament is spaced from the attachment clip via a length of the elongated shaft;

wherein:

the second jaw includes an external hook opposite the first jaw, the ornament includes an electrical cord extending therefrom, and the electrical cord is clipped to the second jaw via the external hook.

14. A decorative assembly comprising:

a decorative element;

a rigid rod defining and linearly extending between a first end and a second end of the rigid rod, the decorative element being secured to the first end of the rigid rod;

a clamp including a first clamp member and a second clamp member, wherein:

each of the first clamp member and the second clamp member includes a spine portion rotatably coupled about the second end of the rigid rod, each of the first clamp member and the second clamp member includes at least one finger extending away from a corresponding spine portion to an opposite free end with a curvature toward the other of the first clamp member and the second clamp member, the first clamp member and the second clamp member are each biased toward a closed position, and when in the closed position, the at least one finger of the first clamp member crosses the at least one finger of the second clamp member between the spine portion of the first clamp member and the opposite free end of the at least one finger of the first clamp member.

15. The decorative assembly of claim 14, wherein the rigid rod spaces the decorative element from the clamp a distance at least equal to a height of the clamp.

16. The decorative assembly of claim 14, further comprising a coil spring wound about the rigid rod within a cutout of a first protruding portion of the spine portion such that each opposing end of the coil spring contacts a different one of the first clamp member and the second clamp member.

17. The decorative assembly of claim 14, wherein:

the at least one finger of the first clamp member defines a first internal surface and includes a single row of first teeth extending along at least a majority of a first length of the at least one finger of the first clamp member, and each tooth in the single row of first teeth extends inwardly from the first internal surface.

18. The decorative assembly of claim 17, wherein the single row of first teeth is substantially centered between and spaced from each of a first elongated edge and a second elongated edge of the at least one finger of the first clamp member.

* * * * *